United States Patent [19]

Logan

[11] 4,424,864

[45] Jan. 10, 1984

[54] ISOLATION PLUG

[75] Inventor: Charles S. Logan, Lake Charles, La.

[73] Assignee: Conoco Inc., Ponca City, Okla.

[21] Appl. No.: 234,900

[22] Filed: Feb. 17, 1981

[51] Int. Cl.[3] ..... E21B 43/04

[52] U.S. Cl. ..... 166/278; 166/51; 166/181; 166/133

[58] Field of Search ..... 166/278, 133, 51, 181, 166/128, 127, 131, 135, 191, 192, 194, 125, 332, 334, 317, 318, 179, 164, 373, 376, 386

[56] References Cited

U.S. PATENT DOCUMENTS

| | | | |
|---|---|---|---|
| 1,975,162 | 10/1934 | Layne | 166/334 |
| 2,192,236 | 3/1940 | Nalley, Jr. | 166/268 |
| 2,297,308 | 9/1942 | Layne | 166/278 |
| 2,299,057 | 10/1942 | McClain | 166/317 |
| 2,738,016 | 3/1956 | Lynes | 166/181 |
| 2,776,015 | 1/1957 | Bielstein | 166/181 |
| 2,906,338 | 9/1959 | Shook | 166/278 |
| 2,927,640 | 3/1960 | Kenneday | 166/205 |
| 3,032,108 | 5/1962 | Bielstein | 166/202 |
| 3,042,116 | 7/1962 | Sharp et al. | 166/133 |
| 3,211,231 | 10/1965 | Bramlett | 166/128 |
| 3,306,366 | 2/1967 | Muse | 166/334 |
| 3,381,755 | 5/1968 | Morrison | 166/202 |
| 3,455,387 | 7/1969 | Peters | 166/278 |
| 3,627,045 | 12/1971 | Lebourg | 166/278 |

OTHER PUBLICATIONS

*Composite Catalog of Oil Field Equipment and Services,* 33rd revision, 1978–1979, published by *World Oil,* at vol. 3, pp. 5322 and 5404E.

*Primary Examiner*—James A. Leppink
*Assistant Examiner*—Hoang C. Dang
*Attorney, Agent, or Firm*—A. Joe Reinert

[57] ABSTRACT

Apparatus and methods are provided for isolating a zone of a well bore from a portion of the well bore located above the zone, to prevent communication between the zone and the portion of the well bore located thereabove.

23 Claims, 20 Drawing Figures

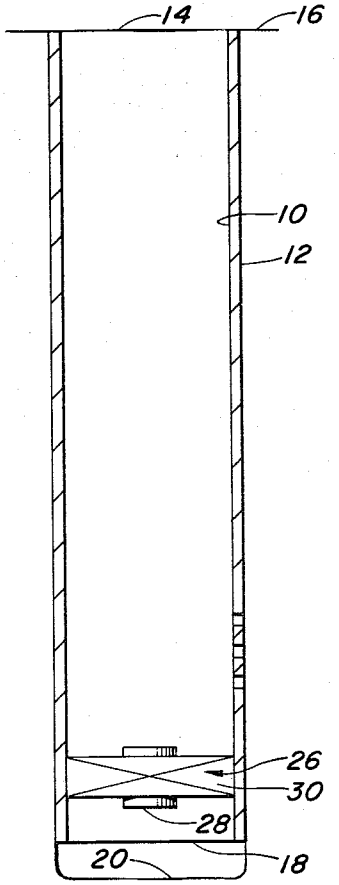
PRIOR ART FIG. 8
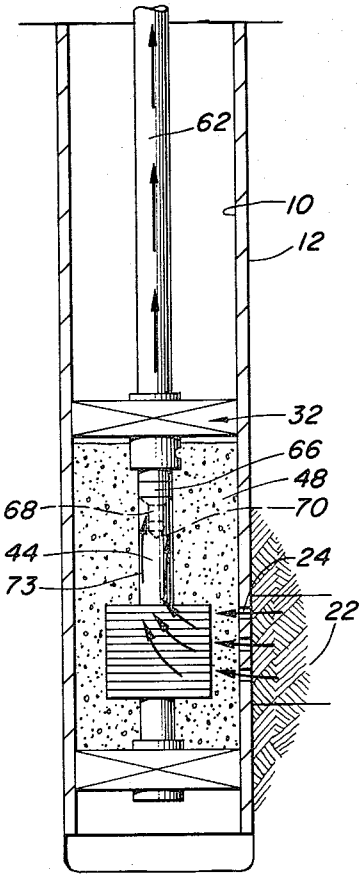
PRIOR ART FIG. 7
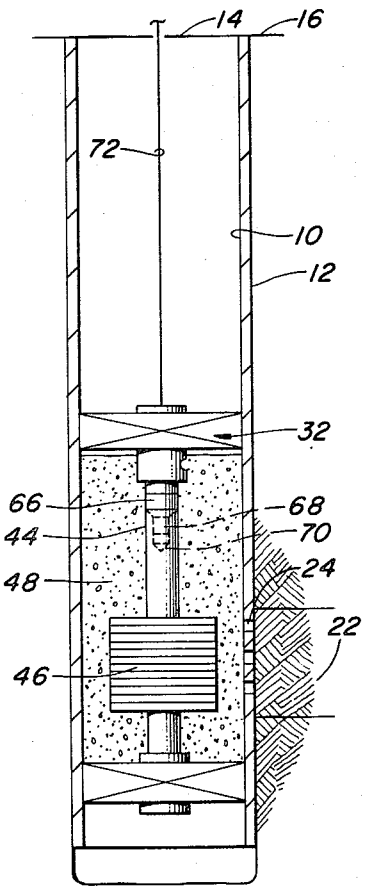
PRIOR ART FIG. 6
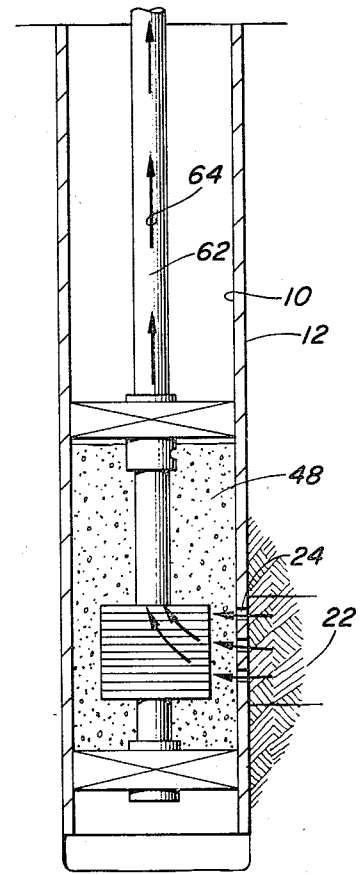
PRIOR ART FIG. 5

ISOLATION PLUG

BACKGROUND OF THE INVENTION

1. Field of the Invention

This invention relates generally to apparatus and methods for isolating an upper portion of a well bore from a lower portion of a well bore, and more particularly, but not by way of limitation, to methods of gravel packing a selected zone of a well bore of an oil or gas well and of isolating said zone from a portion of the well bore located thereabove upon completion of the gravel packing operation.

2. Description of the Prior Art

One operation sometimes performed during the completion of an oil or gas well is the packing of a selected zone of the well bore, adjacent a producing subsurface formation, with particulate material. Such operations are generally referred to as "gravel packing". The term "gravel packing" is, as will be understood by those skilled in the art, defined for the purposes of this invention as including the packing of the selected zone of the well bore with any particulate material even though that particulate material may be of such a size that it would be referred to in lay terms as sand rather than gravel. This particulate material is carried down to the zone to be gravel packed in a slurry of liquid and particulate material, and the slurry is squeezed into the selected zone until the zone is packed substantially as densely as is possible with the particulate material.

One particular problem which has been encountered with prior art gravel packing apparatus and methods is that upon completion of the gravel packing operation, when the tubing string which conducts the slurry to the zone is withdrawn from an upper annular packer defining the upper end of the zone, the subsurface formation communicated with the gravel packed zone is thereby communicated with the portion of the well bore located above the upper packer. Thus, if there is a pressure differential between the producing zone and the well bore located thereabove, kicks or blowouts may occur since the producing zone is communicated with the well bore.

Two particular prior art methods and apparatus for performing gravel packing operations are illustrated in FIGS. 1–7 and in FIGS. 8–12, respectively. Those prior art methods will now be described with reference to those figures.

FIGS. 1–5 schematically illustrate five sequential steps in the performing of what is generally referred to as a "high density" gravel packing operation.

FIG. 1 schematically illustrates, in elevation, a well having a well bore 10 defined by a well casing 12. The well casing 12 extends from an upper end 14 at a ground surface 16 to a lower end 18. Located below lower end 18 is the blind lower end of the uncased well bore which is generally referred to as a rathole 20.

The well intersects a subsurface hydrocarbon producing formation 22 and the well bore 10 is communicated therewith by a plurality of casing perforations 24.

Generally, the first step which is involved in constructing a gravel packing apparatus in a well and performing the gravel packing operation is to lower a lower packer means 26 into the well bore 10 and set the packer means 26 in the well bore 10 at a lower end of the zone of the well bore which is to be gravel packed. The lower packer means 26 is generally referred to as a sump packer and it may be run and set by an electric line as will be understood by those skilled in the art. The sump packer 26 generally includes a packer body 28 having a longitudinal passageway disposed therethrough and having an inflatable annular packing element 30 disposed thereabout for sealing an annulus between the packer body 28 and the well bore 10.

Referring now to FIG. 2, the resulting apparatus from the next series of steps is there illustrated. First, an upper packer means 32 is made up on a lower end of a supply tubing string 34. Upper packer means 32 generally includes a packer body 36 having a lower packer body extension 40, and includes an inflatable packing element 42 for sealing between packer body 36 and well bore 10. Connected to a lower end of packer body 36 is an intermediate tubing 44 which is generally referred to as a "blank" or "blank tubing". Connected to a lower end of the blank tubing 44 is a production screen means 46 which communicates a zone 48 of well bore 12 defined between upper and lower packers 32 and 26 with an interior of blank tubing 44, and thus with a longitudinal passageway disposed through packer body 36 of upper packer 32. Connected to a lower end of production screen means 46 is a lower tubing 47.

The upper packer 32, blank tubing 44, screen means 46, and lower tubing 47 are made up upon supply tubing string 34 before the supply tubing string 34 is lowered into the well bore 10. Then, the supply tubing string 34 with the described attached apparatus is lowered into the well bore 10 until the upper packer means 32 is located at an elevation at which it is desired to define the upper end of the zone 48 to be gravel packed. Then the upper packer means 32 is set in the well bore 10 as shown in FIG. 2 to seal the annulus between the packer body 36 and the well bore 10. Generally, the lower tubing 47 will be sealingly received within the longitudinal passageway of packer body 28 of lower packer means 26.

Next, the slurry containing the particulate material is pumped down the interior of supply tubing string 34. Initially, the fluid previously present in the supply tubing string 34 is circulated out an upper port means 50 associated with a running tool 60 attached to tubing string 34 and as indicated by arrows 52, into an annulus between supply tubing string 34 and well bore 10 above upper packer means 32. This procedure continues until the slurry containing the particulate material is located a short distance above the upper packer means 32. This procedure is known in the art as "spotting" the gravel slurry. This spotting procedure is generally performed with the supply tubing string 34 held in tension so as to hold open the port means 50.

As will be understood by those skilled in the art, there is connected to the lower end of tubing string 34 the running tool 60 (see FIG. 4) which is disposed within the longitudinal passageway of packer body 36, and the port means 50 and other ports to be discussed below, are generally associated with both the packer body 36 and the running tool 60. Thus, manipulation of the tubing string 34 and the connected running tool 60 is generally performed to produce predetermined relative movements between the running tool 60 and the packer body 36 to open and close various ports located therein and to operate various other components of the packer body 36 or associated therewith as is further described below.

After the spotting operation has been completed, weight is set down upon the tubing string 34 to close the upper port means 50 and to open a lower port means 54 associated with lower packer extension 40. This lower port means 54 is communicated with the supply tubing string 34 so that the slurry containing particulate material may then be introduced into the zone 48 through the lower port means 54.

This is illustrated in FIG. 3 where the arrows 56 represent the flow path of the particulate material down the tubing string 34, then through the packer body 36, then out the lower port means 54 into the zone 48. The slurry containing particulate material is squeezed into the zone 48 and fluid therefrom is squeezed out of the slurry and may flow out through the perforations 24 leaving the zone 48 densely packed with particulate material as schematically represented by the particles 58.

When the zone 48 is completely packed with particulate material 58, as schematically represented in FIG. 3, the supply tubing string 34 is withdrawn from packer body 36 of upper packer means 32 and is retrieved up to the ground surface 16. FIG. 4 schematically represents the supply tubing string 34 after it has been withdrawn from upper packer means 32 and as it is being retrieved to the ground surface 16. Schematically represented on the lower end of tubing string 34 is the running tool 60 previously referred to. As the running tool 60 is withdrawn from packer means 32 it closes lower port means 54.

During the operation illustrated in FIG. 4, the subsurface formation 22 is communicated with the zone 48 through the perforations 24 and with an interior of blank tubing 44 through production screen means 46. The interior of blank tubing 44 is communicated with the longitudinal passageway disposed through packer body 36 and is thus communicated with the well bore 10 located above upper packer means 32. Thus, if there is a pressure differential between the subsurface formation 22 and the well bore 10, there is the possibility of a kick or blowout occurring wherein fluid would flow upwardly through screen 46, blank tubing 44, packer body 36, and upper portion of well bore 10 in an uncontrolled manner. Similar problems can occur if there is a second subsurface formation located above upper packer 32 which is also communicated with the well bore 10 thus allowing communication between two previously separate subsurface formations. As will be understood by those skilled in the art, numerous problems can occur in such a situation where a subsurface formation containing fluid under pressure is not controllably contained by the oil well equipment.

After the supply tubing 34 has been retrieved, a production tubing string 62 is lowered into the well and connected to upper packer body 36 so that an interior of production tubing 62 is communicated through packer body 36, blank tubing 44, and production screen means 46, with the gravel packed zone 48 and thus with the subsurface producing formation 22 through the perforations 24 in the well casing 12. Then, the oil or gas from subsurface formation 22 may be produced upwardly through production tubing string 62 as indicated by arrows 64.

The problem of kicks or blowouts occuring between the gravel packed zone 48 and the well bore 10 located above upper packer means 32 is present during the period of time represented in FIG. 4 wherein the longitudinal passageway through the packer body 36 of upper packer means 32 is communicated with the well bore 10 above the packer means 32 and with zone 48.

The prior art has included some apparatus and methods for blocking that longitudinal passageway of upper packer body 36. These methods have required that after the supply tubing string 34 is retrieved, a plug means of a type generally referred to as a "cast iron bridge plug" is lowered either on an electric line or with a tool string into the well bore and through the packer means 36 into the blank tubing 44. Then the cast iron bridge plug is set within the blank tubing 44 either by electrical means or by manipulation of a tool string.

This prior art method of isolating the gravel packed zone 48 from the well bore 10 above upper packer means 32 is illustrated with reference to FIGS. 6 and 7.

In order to isolate zone 48 from the well bore 10 with prior art methods, the blank tubing 44 is initially made up with an adapter 66 located therein which includes, extending downward therefrom, a relatively short tubular section 68 which is concentrically received within the blank tubing 44.

Then, after the procedures illustrated and described with reference to FIG. 4 are completed, a cast iron bridge plug 70 is lowered into the inner tubing section 68 on an electric line 72 from the ground surface 16 and is set in the inner tubing section 68 by electrical means. Also, as previously mentioned, the cast iron bridge plug 70 may be set with a mechanical string in place of the electric line 72.

It is apparent from this description that even with this prior art method of isolating gravel packed zone 48 from the well bore 10 located above upper packer means 32, a period of time must exist between the time when the supply tubing string 34 is withdrawn from packer body 36 and the time at which the cast iron bridge plug 70 has been lowered on the electric line 72 and set within the inner tubing 68. Thus, this prior art method does not completely avoid the dangers present due to kicks and blowouts from pressure within subsurface formation 22 since the subsurface formation 22 is still communicated with the well bore 10 above upper packer means 32 for a substantial period of time during which the supply tubing string 34 is retrieved from the well bore 10 and during which the electric line 72 is lowering the bridge plug 70 into the well bore and into the concentric inner tubing 68 within which it is to be set.

Additionally, when it is desired to produce fluids from the subsurface formation 22 with the apparatus illustrated in FIG. 6, it is necessary to perforate the inner concentric tubing section 68 above the cast iron bridge plug 70 thus allowing the fluids to be produced in a manner illustrated in FIG. 7. The arrows 73 illustrate the flow of fluid from formation 22, through perforations 24, into production screen means 46, up through blank tubing 44 and an annular space between blank tubing 44 and inner concentric tubing 68, to an elevation above cast iron bridge plug 70, then through the perforations just described in the inner concentric tubing 68 into the inner concentric tubing 68, then up through the packer body 36 and the production tubing string 62. As will be understood by those skilled in the art, with the procedure of FIGS. 6 and 7 there is often considerable difficulty in creating the necessary perforations in the inner concentric tubing 68.

Referring now to FIGS. 8–12, five sequential illustrations are shown of a second type of prior art gravel packing apparatus and method, which is generally used to perform what is known as a "circulating pack" gravel packing operation. The circulating pack operation is generally utilized where the length of the zone to be packed is greater than thirty feet. Where the length of the zone to be packed is less than thirty feet, the high density gravel packing method of FIGS. 1–5 is generally used. When the length of the zone to be packed is greater than thirty feet, it has been experienced that problems occur in completely filling the zone with particulate material, particularly at its lower extremities, and thus the circulating pack method described below is preferable.

As shown in FIG. 8, the circulating pack method begins in the same manner as did the high density packing method by setting a lower sump packer 26 within the well bore 10 by means of an electric line.

Referring now to FIG. 9, it is seen that the apparatus made up on the lower end of supply tubing string 34 is different for the circulating pack method. With the circulating pack method there is additional apparatus connected to the lower end of production screen means 46, and additional apparatus is connected to the lower end of the running tool disposed in packer body 36 and connected to supply tubing string 34.

A seal bore nipple 74 is connected to a lower end of production screen means 46. A tell tail screen 76 is connected to a lower end of seal bore nipple 74. The lower tubing 47 is connected to a lower end of tell tail screen 76.

Connected to a lower end of the running tool disposed within the longitudinal passageway of packer body 36 of upper packer means 32 is a wash pipe 78, a lower end of which is sealingly received within an inner bore of seal bore nipple 74 and the interior of which communicates with the interior of the tell tail screen means 76.

The apparatus just described is made up to the supply tubing string 34 before the supply tubing string 34 is lowered into the well bore 10. Then the supply tubing string and attached apparatus is lowered into the well bore 10 until the upper packer means 32 is located at an elevation at which it is desired to define the upper end of the zone 48 to be gravel packed. Then the upper packer means 32 is set in the well bore 10 to seal between the packer body 36 and the well bore 10.

Generally, when the upper packer means 32 is set within the well bore 10, the lower tubing 47 is sealingly received within packer body 28 of lower packer means 26.

The running tool utilized in circulating pack methods is generally referred to by those skilled in the art as a "crossover running tool". This crossover running tool in association with the packer body 36 operates such that when the supply tubing string 34 is in tension, the interior of supply tubing string 34 is communicated with lower port means 54 of packer body 36 of upper packer means 32. Thus, the slurry flows down supply tubing 34 out the lower port means 54 into the zone 48. The tell tail screen means 76 is, however, at the same time communicated through the wash pipe 78 and through the upper port means 50 of the running tool with the well bore 10 above upper packer means 32, so that the slurry flows downwardly through zone 48 toward the tell tail screen 76 since the pressure at tell tail screen 76 is less than the pressure required to force the fluid out into the subsurface formation 22. The particulate material 58 thus initially concentrates in the lower extremity of the zone 48 and fluid from the slurry flows through the tell tail screen means 76, up through the wash pipe 78, then out the upper port means 50 into the well bore 10 above upper packer means 32. Since the zone 48 is full of fluid there will be some particulate material 58 throughout the zone, but it will initially concentrate at the lower end of zone 48. The lower end of zone 48 will become relatively densely packed with particulate material and when an upper level 80 of this densely packed portion of zone 48 reaches the level of tell tail screen means 76 it will be apparent at the surface 16 due to an increase in pressure necessary to force additional slurry material into zone 48.

At this time, the weight of the tubing string 34 is set down upon the upper packer means 32, thus closing the upper port means 50 to prevent further circulation of fluid from the slurry. The lower port means 54 remains open as illustrated in FIG. 10 and additional slurry is then squeezed into the zone 48 to densely fill the remainder of the zone 48 with particulate material 58 and the fluid from the slurry is squeezed out of the zone 48 through the perforations 24 into the subsurface formation 22.

After the zone 48 is completely packed with particulate material as illustrated in FIG. 10, the supply tubing string 34 and attached crossover running tool 82 and wash pipe 78 are disconnected from upper packer means 32 and withdrawn therefrom, and are retrieved to the ground surface 16 as illustrated in FIG. 11. As the running tool 82 is withdrawn it closes lower port means 54.

During the operation illustrated in FIG. 11, it is apparent that subsurface formation 22 is communicated through the perforations 24 with the zone 48, and through the production screen means 46, the blank tubing 44, and the longitudinal passageway of packer body 36, with the well bore 10 above upper packer means 32. Thus, it is apparent that the problem of kicks and blowouts may occur, just as is possible with the high density gravel packing method at the similar point illustrated in FIG. 4.

Then, the production tubing string 62 is lowered into connection with the upper packer means 32 to produce fluids from subsurface formation 22 through perforations 24, production screen means 46, blank tubing 44, and the packer body 36.

With the circulating pack apparatus and methods of FIGS. 8–12, the prior art has also included the use of an isolation means similar to that illustrated in FIGS. 6 and 7, wherein an inner concentric tubing is run in place with the blank tubing 44 and, subsequent to the withdrawal of the supply tubing 34 illustrated in FIG. 11, a cast iron bridge plug such as bridge plug 70 of FIGS. 6 and 7 can then be run on an electric line or on a mechanical string and set within the blank tubing 44.

The apparatus and methods described above with reference to FIGS. 1–12 are all a part of the prior art. It is seen that although the prior art includes apparatus and methods for performing gravel packing operations, and although the danger of allowing communication between the gravel packed zone 48 and the well bore 10 above the upper packer means 32 subsequent to the withdrawal of supply tubing string 34 and prior to the connection of production tubing string 62 has been known, the prior art has not included any apparatus or methods for isolating gravel packed zone 48 from the well bore 10 located thereabove prior to the withdrawal of the supply tubing string 34 from the upper packer means 32.

SUMMARY OF THE INVENTION

The present invention provides apparatus and methods for isolating the gravel packed zone 48 from the well bore 10 located above upper packer means 32 prior to the withdrawal of supply tubing string 34 from the upper packer means 32, so that the possibility of kicks and blowouts occurring upon withdrawal of the supply tubing string 34 is eliminated. A releasable plug means is run into the well with the supply tubing string 34 and the attached apparatus. In the high density gravel packing method the plug means is already in place blocking the longitudinal passageway of the packer body 36 of the upper packer means 32 when all of the apparatus is run into place within the well bore 10. In the circulating gravel pack method, the plug means is initially attached to a lower end of the wash pipe 78 and then is securely fastened within the blank tubing 44 after the gravel packing operation has been completed and prior to the complete withdrawal of the supply tubing 34, running tool 82 and wash pipe 78 from the upper packer means 32. Both of these plug means are releasable so that when the production tubing string 62 is connected to the upper packer means 32 and it is desired to produce fluid from the subsurface formation 22, the plug means may be removed allowing communication between the production tubing string 62 and the subsurface formation 22 without the need for any additional perforation operations to be performed.

It is, therefore, a general object of the present invention to provide improved apparatus and methods for isolating an upper portion of a well bore from a lower portion of the well bore.

Another object of the present invention is to provide improved apparatus and methods for performing high density gravel packing operations.

Yet another object of the present invention is the provision of improved apparatus and methods for performing circulating pack gravel packing operations.

Still another object of the present invention is the provision of apparatus and methods for isolating a gravel packed zone from a well bore located thereabove to prevent any communication between said zone and said well bore so as to prevent kicks, blowouts and the like.

Another object of the present invention is the provision of apparatus and methods utilizing a plug means to isolate a gravel packed zone from a well bore located thereabove and for preventing release of the plug means due to fluid pressure acting thereon.

Yet another object of the present invention is the provision of apparatus and methods for releasing such a plug means from the blank tubing to allow production of fluids from a subsurface formation upwardly through the blank tubing to a production tubing string.

Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIGS. 1–5 comprise five sequential schematic illustrations of a prior art high density gravel packing operation.

FIGS. 6 and 7 illustrate a modification of the prior art methods of FIGS. 1–5 showing a cast iron bridge plug set within the blank tubing after the supply tubing has been withdrawn from the upper packer means, which modifications of FIGS. 6 and 7 are also a part of the prior art.

FIGS. 8–12 comprise a sequential series of schematic illustrations of a circulating pack gravel pack method and apparatus which is included in the prior art.

In FIGS. 16A–16B, the plug means is initially attached to the wash pipe which is in place within the seal bore nipple to allow fluid from the slurry to circulate upwardly through the wash pipe.

DETAILED DESCRIPTION OF THE PREFERRED EMBODIMENTS

Figure 2:
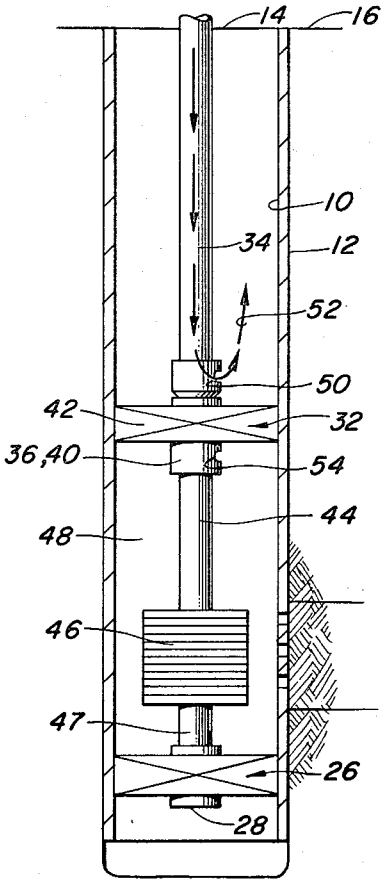
PRIOR ART FIG. 2
Figure 1:
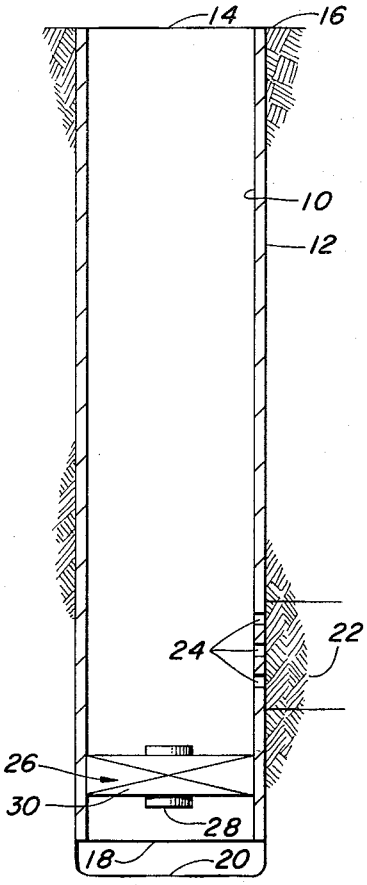
PRIOR ART FIG. 1
Figure 12:
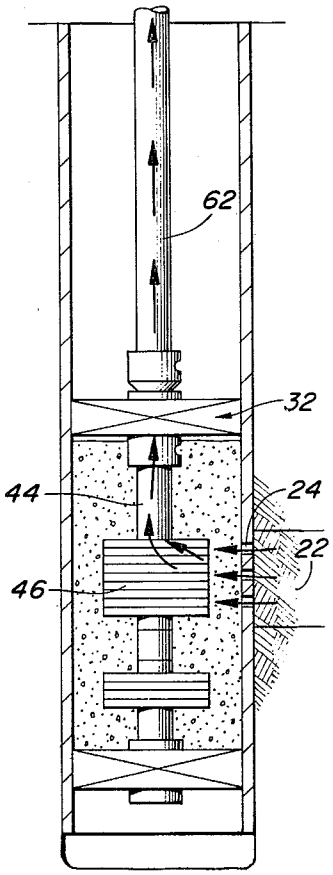
PRIOR ART FIG. 12
Figure 11:
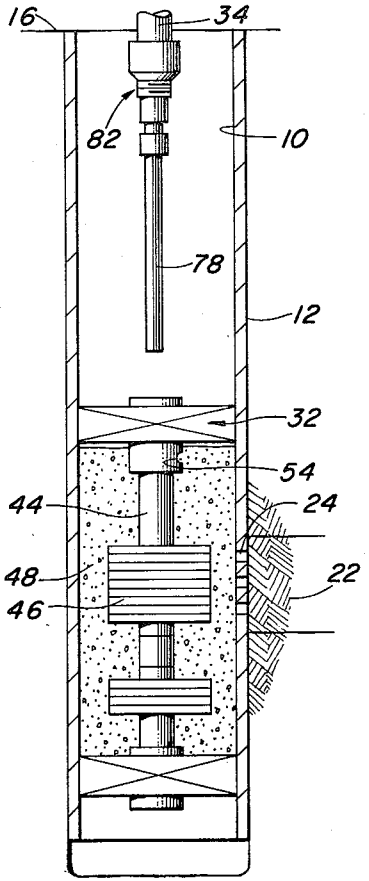
PRIOR ART FIG. 11
Figure 10:
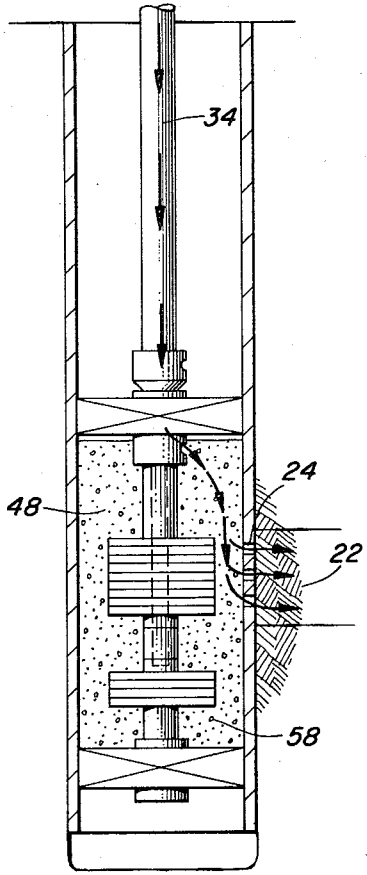
PRIOR ART FIG. 10
Figure 9:
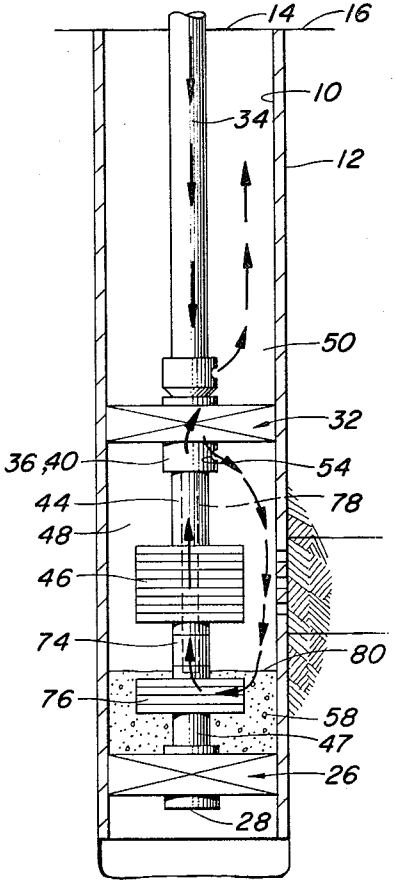
PRIOR ART FIG. 9
Figure 13:
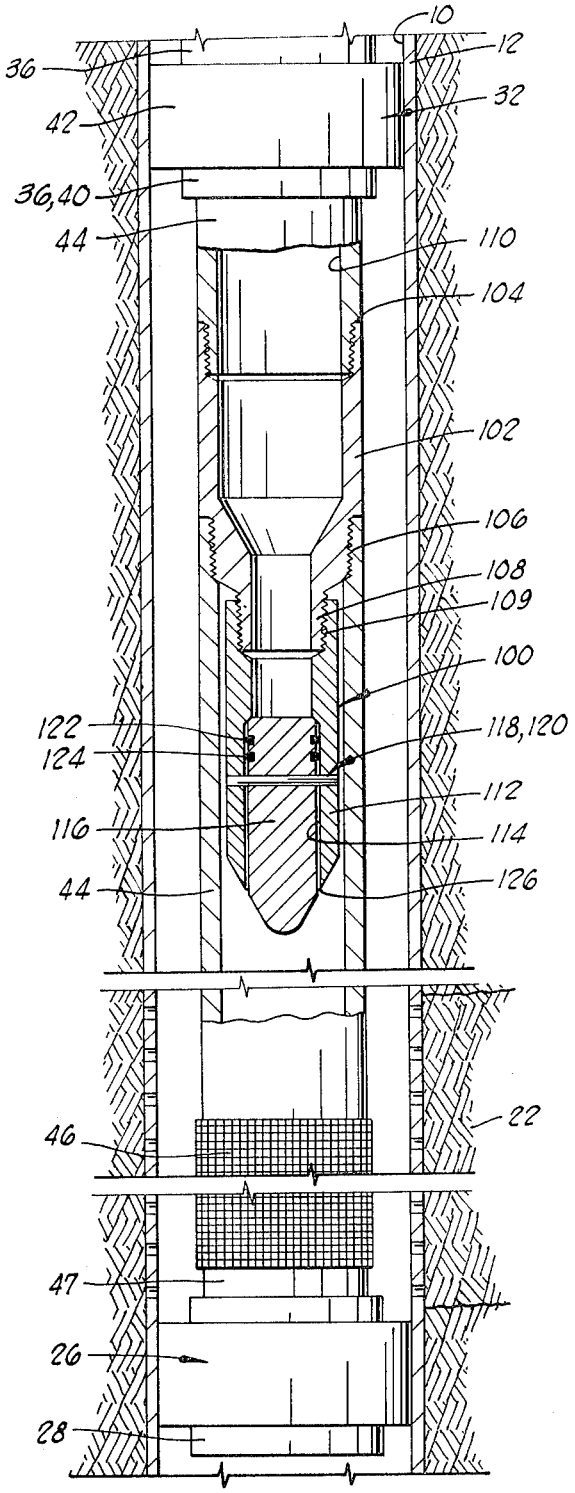
FIG. 13 is a schematic elevation illustration illustrating a first embodiment of the isolation plug of the present invention in place within the blank tubing of an apparatus for a high density gravel packing operation.

Referring now to FIG. 13, a view is thereshown, somewhat similar to FIG. 2, of an apparatus for performing a high density gravel packing operation. This apparatus includes in combination therewith the isolation means of the present invention generally designated by the numeral 100. The isolation means 100 is located within the blank tubing section 44 previously described with regard to FIG. 2.

The isolation means 100 includes a double threaded adapter 102 which has an internally threaded upper box end 104 which is attached to a lower pin end of a section of the blank tubing 44, and includes an externally threaded lower pin end 106 which is threadedly received in an upper box end of a second portion of blank tubing section 44.

Adapter 102 includes a reduced diameter portion 108 having external threads 109.

As can be seen in FIG. 13, the blank tubing 44 has an interior 110, and that interior 110 is communicated with the longitudinal passageway disposed through packer body 36 of upper packer means 32. Interior 110 may also be referred to as a longitudinal tubing passageway.

The isolation means 100 further includes a housing 112 having a central bore 114 communicated with the longitudinal passageway of packer body 36 through the interior 110 of blank tubing 44.

A plug means 116 is disposed in central bore 114 for blocking central bore 114 and the longitudinal passageway of the packer body 36.

A releasable retaining means, generally designated by the numeral 118, provides a means for initially retaining the plug means 116 in the central bore 114 and for subsequently releasing the plug means 116 so that it may be displaced from the central bore 114 to communicate the well bore 10 above upper packer means 32 with the zone 48 through the production screen means 46.

Thus, the isolation means 100 may generally be described as being connected to the packer body 36 for blocking the longitudinal passageway thereof and thereby isolating the upper portion of the well bore 10 above upper packer means 32 from a lower portion of the well bore 10, namely the zone 48.

While the isolation means 100 is particularly disclosed herein with regard to embodiments thereof designed for use in gravel packing operations, it will be appreciated by those skilled in the art that the apparatus and methods hereof may be utilized in any instance wherein it is desirable to isolate an upper portion of a well bore from the lower portion of the well bore.

Figure 4:
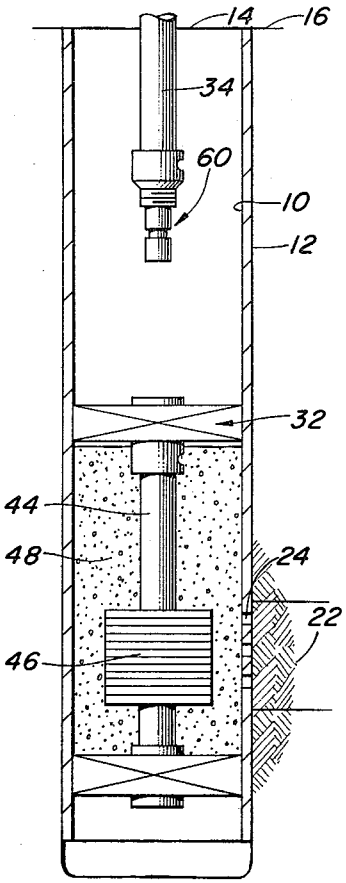
PRIOR ART FIG. 4
Figure 3:
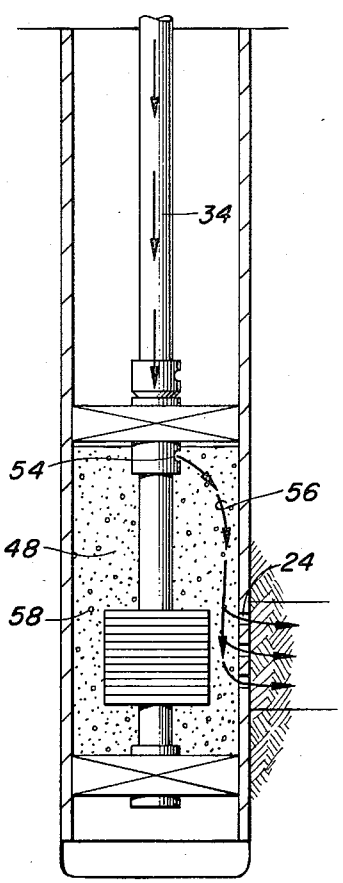
PRIOR ART FIG. 3

As mentioned, the isolation means 100 is run in place with the blank tubing 44 when the blank tubing 44 and the attached apparatus is initially run into and set in the well bore 10 by the supply tubing string 34, in a manner similar to that illustrated in FIG. 2. Then, the high density gravel packing operation is carried out in a manner like that described in relation to FIGS. 2 and 3. When, however, the supply tubing string 34 is withdrawn from upper packer means 32 as illustrated in FIG. 4, the well bore 10 above upper packer means 32 is isolated from the gravel packed zone 48 by the isolation means 100, thus preventing any kicks or blowouts from occurring.

The particular embodiment of the isolation means 100 illustrated in FIG. 13 has the plug means 116 constructed as a solid plug means which is releasably connected to the housing 112 by a shear pin 120 disposed through respective transverse bores in the plug 116 and housing 112. Thus, the releasable retaining means 118 includes the shear pin 120 as connected to the plug means 116 and housing 112.

First and second annular O-ring seal means 122 and 124 are disposed between the plug means 116 and the central bore 114 of housing 112 for sealing therebetween.

The housing 112 has an open lower end 126 so that the plug means 116 may be completely removed from the housing 112 by displacing the plug means 116 downward relative to the housing 112. Thus, when it is desired to produce fluids from the subsurface formation 22, a downward force is exerted upon plug means 116 to shear the shear pin 120 thus allowing the plug means 116 to be displaced downward out of housing 112 and unblocking the central bore 114 thereof and the longitudinal passageway through packer body 36. This allows fluid from the subsurface formation 22 to be produced through perforations 24, zone 48, production screen 46, and upward through central bore 114, interior 110 of blank tubing 44, and the longitudinal passageway of packer body 36 into production tubing screen 62.

When the plug means 116 is displaced from the housing 112 it falls downward through blank tubing 44, production screen 46, lower tubing 47, packer body 28 of lower packer means 26, and into the rathole 20 of the well. This leaves the blank tubing 44 completely open for fluid flow and remedial work, which is a significant advantage as compared to the prior art methods described with reference to FIGS. 6 and 7.

With the design of the isolation means 100 illustrated in FIG. 13, the releasing means 118 may be released by exerting downward force on the plug 116 either by mechanical means or by fluid pressure within the interior 110 of blank tubing 44.

Figure 14:
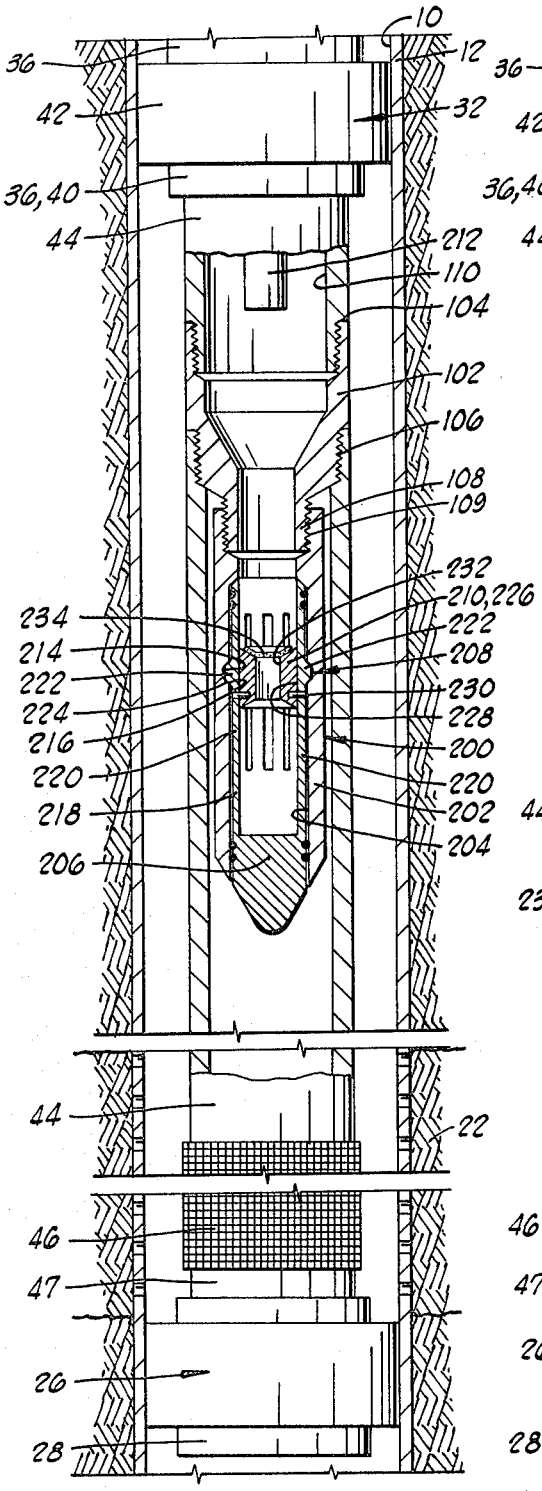
FIG. 14 is an illustration similar to FIG. 13 showing a second embodiment of the isolation plug of the present invention for use in a high density gravel packing operation.

Referring now to FIG. 14, a view similar to FIG. 13 is shown of a second embodiment of the present invention designed for use in a high density gravel packing operation wherein the isolation means generally designated in FIG. 14 by the numeral 200 is designed so that it may be released only by physical engagement thereof with an operating tool, and may not be released due to pressure within the interior 110 of blank tubing 44. The isolation means 200 of FIG. 14 includes the adapter 102 of FIG. 13 but differs in the construction of the housing, plug means, and releasable retaining means.

The isolation means 200 includes a housing 202, the upper end of which is threadedly attached to threads 109 of the reduced diameter portion 108 of adapter 102. Housing 202 includes a central bore 204 communicated with the longitudinal passageway of packer body 36 of upper packer means 32. A plug means 206 is disposed in the central bore 204 for blocking the central bore 204 and longitudinal passageway of upper packer means 32. A releasable retaining means 208 retains plug means 206 in central bore 204 and subsequently releases the plug means 206 so that it may be displaced from the central bore 204.

The releasable retaining means 208 of isolation means 200 includes a back-up means 210 for preventing release of plug means 206 due to fluid pressure variations within the interior 110 of blank tubing 44. The interior 110 may also be referred to as a longitudinal tubing passageway. The releasable retaining means 208 is designed to be released by physical engagement of a releasing tool therewith. The releasing tool may be a pipe section such as is schematically designated as 212 in FIG. 14.

The central bore 204 of housing 202 has an annular groove 214 disposed therein upon which is defined an upward facing support surface 216.

The releasable retaining means 208 includes a collet 218 which includes a plurality of upward extending spring collet fingers, such as 220, extending upwardly from piston means 206. A plurality of shoulders such as 222 extend radially outward from each of the spring collet fingers 220 and have downward facing surfaces 224 defined thereon. The downward facing surfaces 224 of shoulders 222 are located above support surface 216 of groove 214 and are engaged with support surface 216 to retain the plug means 206 in the central bore 204 of housing 202.

The spring collet fingers 220 provide a resilient spring means for resiliently urging the downward facing surfaces 224 and the upward facing support surface 216 into engagement. The spring collet fingers 202 are, however, displaceable to disengage the downward facing surfaces 224 from the upward facing support surface 216.

It will be understood by those skilled in the art that the spring collet with shoulders 222 engaging groove 214 could be replaced by any number of other equivalent arrangements of an upward facing surface on housing 220, an engaging downward facing surface connected to the plug means 206 and a resilient spring means for urging the two surfaces into engagement. For example, an inward projecting shoulder could be formed on the bore 204 and could be received in outwardly open grooves disposed in the spring collet fingers.

Initially, however, the back-up means 210 prevents the spring collet fingers 220 from being displaced.

The back-up means 210 includes a pressure balanced piston means 226 initially located between and engaging radially inner surfaces 228 of at least two of said spring collet fingers 220 to hold said shoulders 222 of said at least two spring collet fingers 220 within the annular recess 214 of central bore 204 of housing 202.

The pressure balanced piston 226 is initially releasably connected to the spring collet fingers 220 by shear pins 230. The shear pins 230 initially hold the piston 226 in its first position illustrated in FIG. 14.

The piston 226 includes a central opening 232 disposed longitudinally therethrough so that fluid pressure from within the interior 110 of blank tubing 44 is communicated with both the upper and lower ends of piston 226, so that piston 226 is pressure balanced so that no net longitudinal force is exerted thereon due to pressure fluctuations within the interior 110 of blank tubing 44.

A filter screen 234 covers the upper end of central opening 232 for preventing particulate material from passing downward through the opening 232 and collecting on top of the plug means 206. If such particulate material were to collect on top of the plug means 206, it could prevent the piston means 226 from being moved completely downward to its lowermost position as described below. That could, in turn, prevent the spring collet fingers 220 from releasing.

Figure 15:
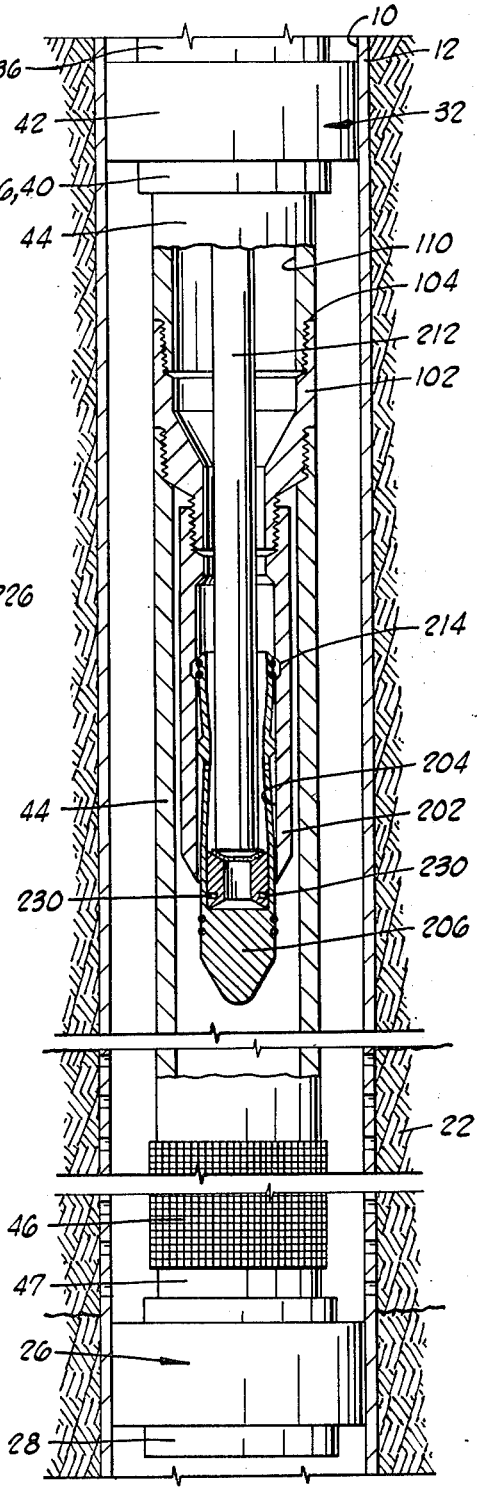
FIG. 15 is a view similar to FIG. 14 illustrating the isolation plug of FIG. 14 after it has been released from and partially displaced from the housing of the isolation means.

Referring now to FIG. 15, a view similar to FIG. 14 is shown with the releasing tool 212 exerting a downward force on the piston 226 and plug means 206 so that the releasable retaining means 208 has released the piston 206 and the plug means 206 is partially displaced out of housing 202.

As is seen in FIG. 15, the piston means 226 is movable from its initial position shown in FIG. 14 downward relative to spring collet fingers 220 to a second position abutting the upper end of plug means 206. In the second position illustrated in FIG. 15, the spring collet fingers 220 are allowed to be displaced radially inward due to the downward force being exerted upon piston 226 and plug means 206 thereby releasing the plug means 206 from the housing 202. The sloped engaging surfaces 216 and 224 cause the resilient spring fingers to be cammed inward as a result of the downward force acting thereacross.

The pressure balanced design of the piston 226 prevents the piston 226 from being displaced due to fluid pressure variations and thus prevents the releasable retaining means 208 from being released due to fluid pressure variations.

The releasing tool 212 continues to push the plug means 206 downward completely displacing it downward out of the central bore 204 of housing 202 and it falls downwardly and lands in the rathole 20 of the well. This allows fluid from the subsurface formation 22 to be produced through the screen 46, upward through the central bore 204 of housing 202, and upward through the interior of blank tubing 44 and through the upper packer means 32 into the production string tubing 62 similar to that illustrated in FIG. 5.

Figure 16A:
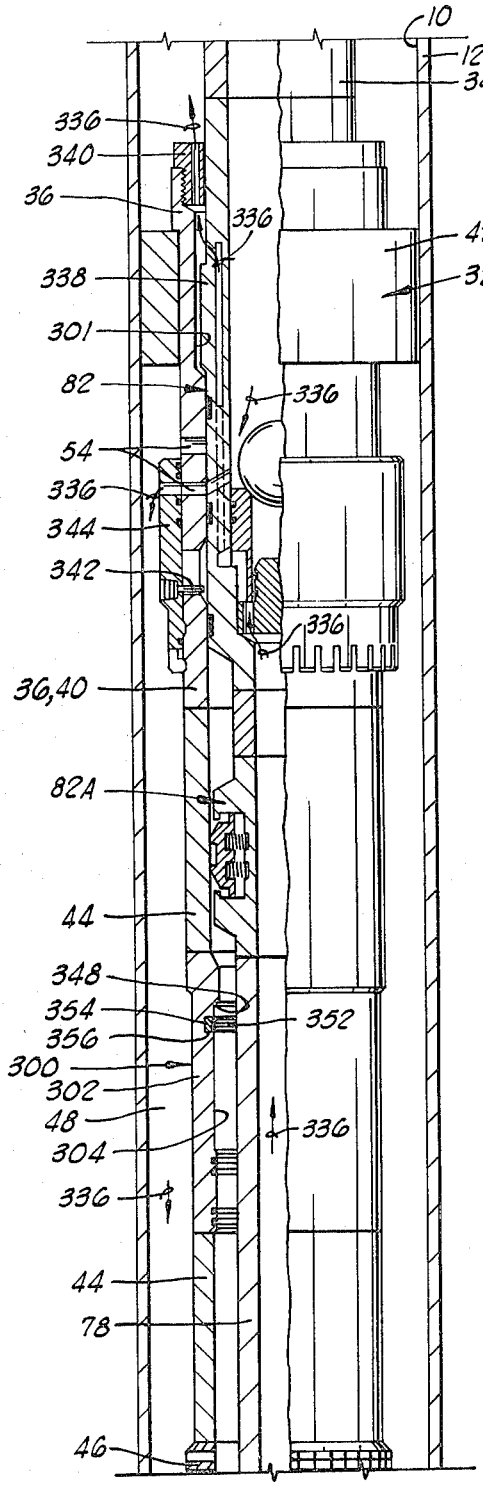
FIGS. 16A–16B comprise a schematic elevation half section view of the isolation plug of the present invention as designed for use with apparatus for a circulating pack gravel packing operation.
Figure 16B:
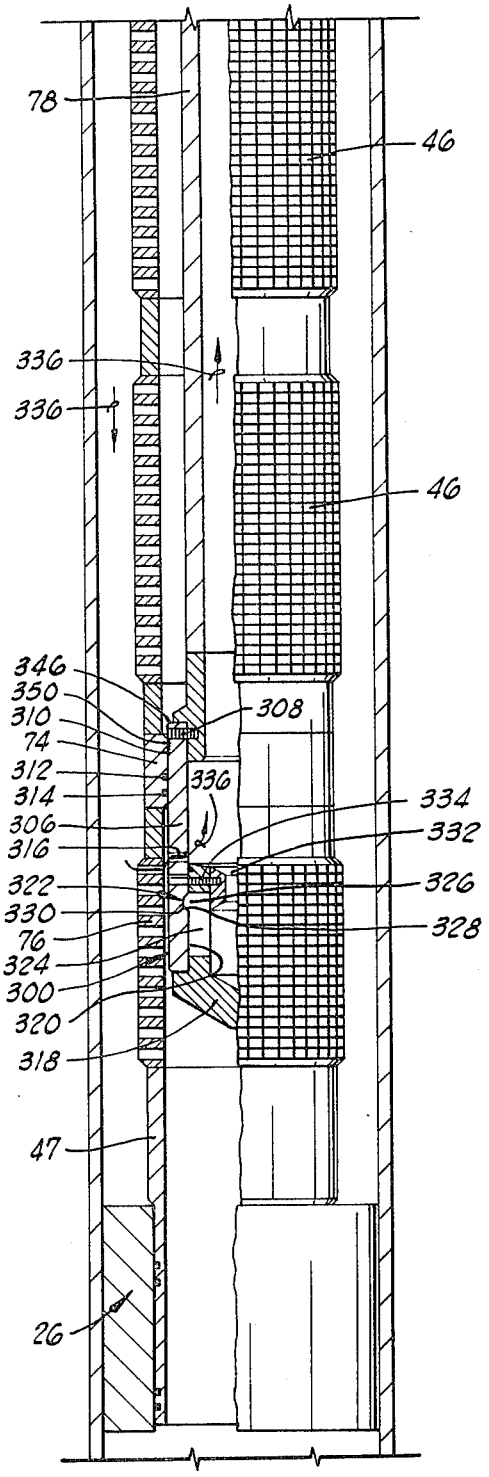

Referring now to FIGS. 16A–16B, these figures comprise a schematic elevation half section view of an apparatus for performing a circulating pack gravel packing operation, which apparatus includes an isolation means constructed in accordance with the present invention.

The apparatus illustrated in FIGS. 16A–16B is similar in many respects to the prior art apparatus of FIGS. 8–12 and similar components are similarly numbered. For example, the apparatus of FIGS. 16A–16B includes upper packer means 32 and its associated components, blank tubing 44, production screen means 46, a seal bore nipple 74, a tell tail screen 76, lower tubing 47 and lower sump packer means 26. The longitudinal passageway of upper packer means 32 is shown and designated by the numeral 301.

Also illustrated in FIGS. 16A–16B and included in the prior art is the supply tubing string 34, the crossover running tool 82, which includes an associated shifting tool 82A located therebelow for closing lower port means 54 in lower extension 40 of packer body 36, and wash pipe 78.

A third embodiment of the isolation means of the present invention is generally designated by the numeral 300 and as can be seen in FIGS. 16A–16B, the isolation means 300 includes two initially separated apparatus in the embodiment shown in FIGS. 16A–16B.

It must be emphasized that FIGS. 16A–16B comprise only a schematic illustration, although they do show in more detail the construction of several of the prior art components such as the upper packer means 32 and the crossover running tool 82.

As seen in FIG. 16A, the intermediate tubing 44 includes disposed therein a portion of the isolation means 300 of the present invention designated as an isolation casing 302. Isolation casing 302 has a central cavity 304 disposed therein.

The isolation means 300 further includes a housing 306 initially attached to a lower end of wash pipe 78 by a shear pin 308. The housing 306 includes an outer cylindrical surface 310 sealingly received within seal bore nipple 74. Seals 312 and 314 seal between the bore of seal bore nipple 74 and the outer surface 310 of housing 306.

A circulating port 316 is disposed through a side wall of housing 306 for communicating the interior of wash pipe 78 with the zone 48 through the tell tail screen means 76.

The isolation means 300 further includes plug means 318 initially sealingly received within a central bore 320 of housing 306 and releasably retained therein by a releasable retaining means 322 constructed similar to the releasable retaining means 208 of FIGS. 14 and 15. The releasable retaining means 322 includes spring collet fingers 324, shoulders 326, upward and downward facing engaging surfaces 328 and 330, pressure balance piston means 332, and shear pins 334 connecting the piston 332 to the collet fingers 324.

The isolation means 300 is initially arranged in the position shown in FIGS. 16A–16B when all of the associated apparatus is lowered in to the well bore 10 and set in place therein in a manner similar to that described above with regard to FIG. 9.

During the circulating phase of the operation, similar to that described previously with regard to FIG. 9, the flow of slurry downward through supply tubing 34, out lower port means 54, then downward through zone 48, then inward through tell tail screen 76, then through circulating port 316, then upward through wash pipe 78, again through crossover running tool 82, and then out through the upper port means 50 is represented by the arrows 336 of FIGS. 16A–16B.

The circulating pack gravel pack operation is carried out in a similar fashion to that described above with regard to FIGS. 8–10.

After the gravel pack operation is completed, the supply tubing string 34 is picked up, thus engaging a shoulder 338 of crossover running tool 82 with a threaded retaining ring 340. Then, the supply tubing string 34 is rotated to release threaded retaining ring 340 from engagement with upper extension 38 of packer body 36.

Figure 17:
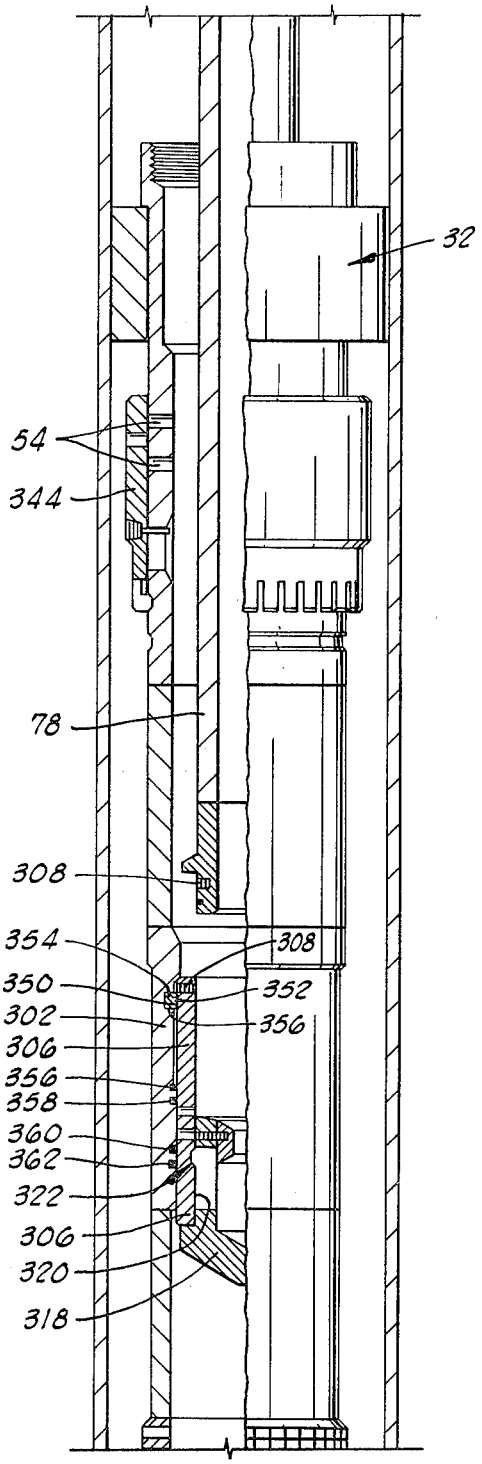
FIG. 17 is a view similar to FIG. 16A, illustrating the arrangement of the parts after the crossover running tool and wash pipe have been partially withdrawn from the upper packer means 32 and the plug means is securely attached to an isolation casing which is a part of the blank tubing. The lower end of the wash pipe has been disconnected from a housing which contains the isolation plug means due to the shearing of a shear pin which previously connected the wash pipe to the housing.

Then, as the supply tubing string 34, attached crossover running tool 82 and shifting tool 82A, wash pipe 78, and isolation means 300 are withdrawn from the packer body 36, the shifting tool 82A engages an inward extending pin 342 on a sleeve 344 of lower packer extension 40 to move sleeve 344 upward to a position illustrated in FIG. 17 to close lower port means 54.

Again it is noted that the crossover running tool 82, shifting tool 82A and upper packer means 32 including sleeve 344 are all in themselves part of the prior art.

Then, further upward movement of the apparatus attached to supply tubing string 34 brings an upward facing upset surface 346 on the upper end of housing 306 into engagement with a downward facing upset surface 348 defined at the upper end of the inner cavity 304 of isolation casing 302, thus preventing further upward movement of housing 306 after it is received within cavity 304 of housing 306. The continuing upward force being exerted upon wash pipe 78 by upward movement of supply tubing string 34 causes shear pin 308 to shear thereby detaching wash pipe 78 from housing 306. Thus, shear pin 308 may be referred to as a releasable housing retaining means.

The supply tubing string 34 may be considered as including the attached components, namely running tool 82, shifting tool 82A and wash pipe 78, as a part thereof. Alternatively the supply tubing string 34 may be referred to as an operating tool string.

Housing 306 includes a serrated outer surface portion 350 which is engaged with radially inner serrations 352 of a securing ring 354 which fits within a groove 356 of inner cavity 304 of isolation casing 302 so that housing 306 is securely attached to isolation casing 302 by engagement of serrated surface 350 with retaining ring 354.

A seal is provided between housing 306 and inner cavity 302 by annular seal means 356, 358, 360 and 362. As is seen in FIG. 17, the seals 356 and 358 seal above circulating port 316 and the seals 360 and 362 seal below circulating port 316 when the housing 306 is securely attached to isolation casing 302.

Thus, the plug means 318 is in place blocking the bore 320 of housing 306, and is releasably retained in place by releasable retaining means 322.

Figure 18A:
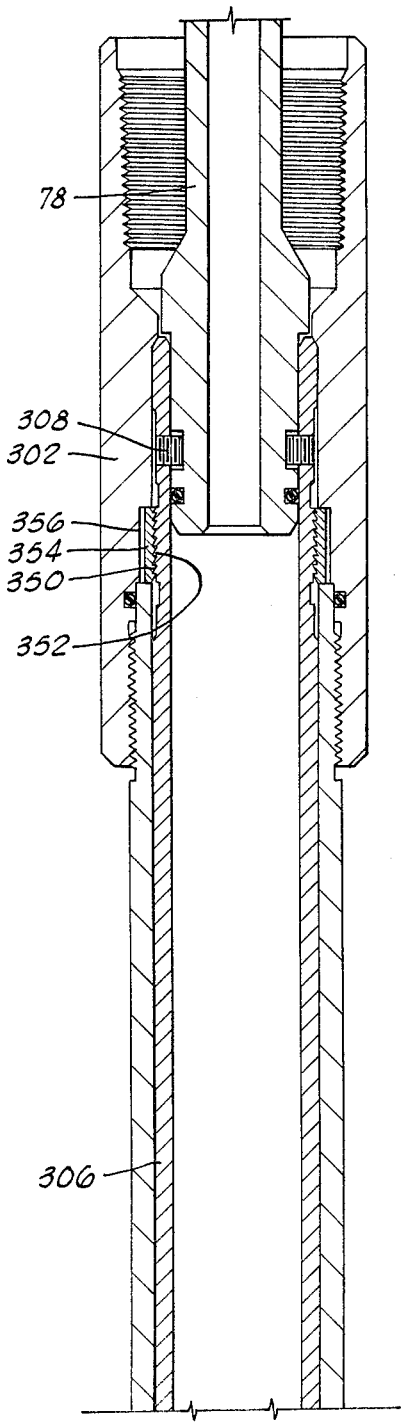
FIGS. 18A–18B comprise an elevation section view of the isolation means of FIG. 17 with the housing securely attached to the isolation casing prior to the shearing of the shear pin connecting the housing to the lower end of the wash pipe.
Figure 18B:
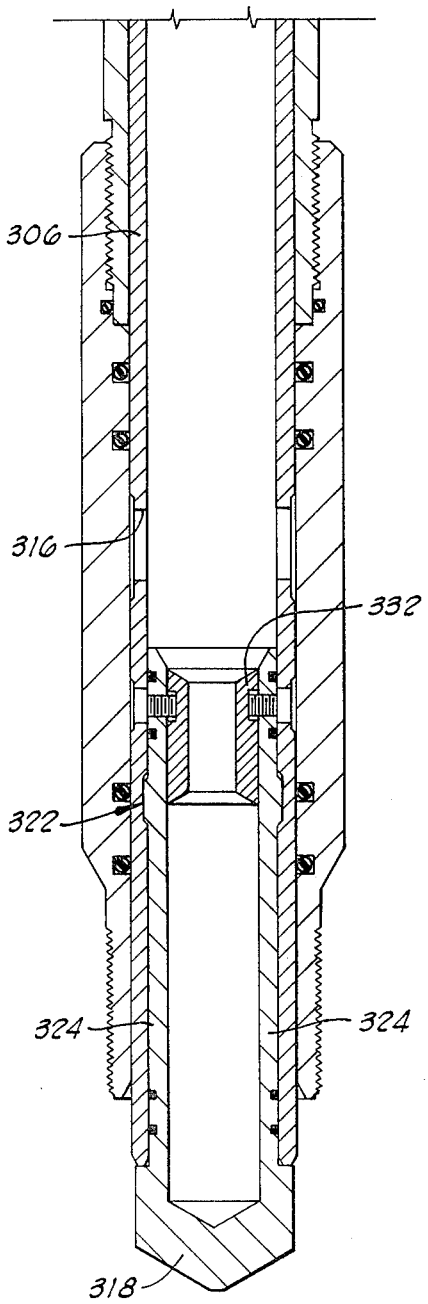

Referring now to FIGS. 18A–18B, a much more detailed view similar to FIG. 17 is thereshown of the housing 306 securely attached to isolation casing 302. As previously mentioned, FIGS. 18A–18B comprise a view prior to the shearing of shear pin means 308, so the wash pipe 78 is still shown attached to the housing 306.

As is best shown in FIG. 18B, the details of construction of the plug means 318 and releasable retaining means 322 are very similar to those of the isolation means 200 of FIGS. 14 and 15, and they are operated in a similar manner by engagement of a releasing tool with piston 332.

METHODS OF OPERATION

The methods of isolating an upper portion of a well bore from a lower portion of a well bore utilizing the apparatus of the present invention, and more particularly, methods of high density gravel packing and of circulating pack gravel packing of a zone of a well bore, utilizing the isolation means apparatus of the present invention may generally be summarized as follows.

Utilizing apparatus such as the isolation means 100 or 200, an upper portion of a well bore may be isolated from a lower portion of the well bore by connecting to a packer body 36 of an annular packer means 32, an isolation means including a housing having a central bore, plug means disposed in said central bore, and releasable retaining means for retaining said plug means in said central bore. By so connecting the packer body and the annular packer means, the central bore of the housing is communicated with the longitudinal passageway of the packer body and the central bore and longitudinal passageway are blocked by the plug means.

Then the connected packer means and isolation means are lowered into the well bore and the annular packer means is set in the well bore between the upper and lower portions of the well bore which are to be isolated from each other.

Subsequently, the upper and lower portions of the well bore may be communicated by releasing the releasable retaining means and displacing the plug means from the central bore of the housing, thereby communicating the upper and lower portions of the well bore through the longitudinal passageway of the packer body.

More particularly, methods of gravel packing a zone of a well bore and of isolating an upper portion of the well bore from said gravel packed zone located therebelow upon completion of the gravel packing operation may generally be summarized as follows. The method includes a step of setting an upper packer means in the well bore at an upper end of the zone. The zone is gravel packed by flowing a gravel slurry down a supply tubing string connected to a packer body of the upper packer means and through lower port means associated with the packer body into the zone to be gravel packed.

The longitudinal passageway of the packer body is blocked with the releasable isolation means prior to completely withdrawing the supply tubing string from the packer body.

Also, the lower port means 54 is closed prior to completely withdrawing the supply tubing string from the packer body.

Then the supply tubing string is completely withdrawn from the packer body, thereby communicating the longitudinal passageway of the packer body with the upper portion of the well bore. By means of the steps described above, the upper portion of the well bore is thereby isolated from the gravel packed zone so long as the longitudinal passageway of the packer body remains blocked by the releasable isolation means.

Subsequently, fluid may be produced from the subsurface formation communicated with the gravel packed zone by connecting the production tubing string to the upper packer means so that the interior of the production tubing string is in fluid communication with the isolation means. Then the isolation means is released thereby unblocking the longitudinal passageway of the packer body.

These steps thereby communicate the interior of the production tubing string with the gravel packed zone of the well bore so that fluid from the subsurface formation may be produced through the production tubing string.

If a circulating pack gravel packing job is being performed, the method of the present invention includes further steps of initially attaching the releasable isolation means to a lower end of the wash pipe, and initially locating said isolation means so that an outer cylindrical surface of the housing of the isolation means sealingly engages a bore of the seal bore nipple connected to the lower end of the packer body so that the circulating port disposed through the housing communicates with the gravel packed zone through the tell tail screen connected to the lower end of the seal bore nipple.

Further, after performing the circulating pack gravel packing operation, the blocking step of the method includes steps of lifting the wash pipe and attached isolation means relative to the upper packer means after the gravel packing operation is completed, engaging the housing of the isolation means with the isolation casing connected to a lower end of the packer body, and securely attaching the housing of the isolation means to the isolation casing thereby blocking the longitudinal passageway of the packer body.

Additionally, in many well completion plans, more than one zone of a well bore may be gravel packed. These gravel packed zones may be adjacent so that one is located directly above the other or they may be separated by an unpacked zone.

For example, if it is desired to gravel pack two adjacent zones, the lower zone may first be gravel packed by either a high density or a circulating pack operation utilizing the isolation plug means of the present invention. Then, after completion of the gravel packing of the lower zone, the upper zone is gravel packed in a similar fashion. The upper annular packer means of the lower zone serves as the lower annular packer means of the upper zone.

Thus, it is seen that the apparatus and methods of the present invention readily achieve the ends and advantages mentioned as well as those inherent therein. While certain preferred embodiments of the invention have been illustrated for the purpose of this disclosure, numerous changes in the arrangement and construction of parts and steps may be made by those skilled in the art, which changes are encompassed within the scope and spirit of this invention as defined by the appended claims.

The embodiments of the invention in which an exclusive property or privilege is claimed are defined as follows:

1. An apparatus for isolating an upper portion of a well bore from a lower portion of said well bore, comprising:

an annular packer means including a packer body having a longitudinal passageway disposed therethrough, and including an expandable packing element for sealing an annulus between said packer body and said well bore between said upper and lower portions of said well bore;

isolation means, connected to said packer body, for blocking said longitudinal passageway and thereby isolating said upper portion of said well bore from said lower portion of said well bore, said isolation means including:

a housing having a central bore communicated with said longitudinal passageway;

plug means disposed in said central bore for blocking said central bore and said longitudinal passageway;

releasable retaining means for retaining said plug means in said central bore and for subsequently releasing said plug means so that it may be displaced from said central bore to communicate said upper portion of said well bore with said lower portion of said well bore, said releasable retaining means including means for preventing release of said plug means due to fluid pressure variations within said longitudinal passageway of said packer body; and an isolation casing connected to said packer body, said isolation casing including a central cavity for receiving said housing of said isolation means therein;

an operating tool string initially disposed through said longitudinal passageway of said packer body; and wherein said housing of said isolation means is initially attached to said operating tool string so that said housing is moved longitudinally with said operating tool string relative to said packer body and said isolation casing.

2. The apparatus of claim 1, wherein:

said releasable retaining means is constructed to be released by physical engagement with a releasing tool.

3. The apparatus of claim 1, wherein:

said housing includes an upward facing support surface; and said releasable retaining means includes:

a downward facing surface located above said support surface of said housing and engaged with said support surface to retain said plug means in said central bore of said housing;

resilient spring means for resiliently urging said downward facing surface and said support surface into engagement, said spring means being displaceable to disengage said downward facing surface and said support surface; and wherein said means for preventing release of said plug means includes a back-up means for preventing said resilient spring means from being displaced due to fluid pressure variations within said longitudinal passageway of said packer body.

4. The apparatus of claim 3, wherein:

said upward facing support surface of said housing is defined on an annular recess disposed in said central bore of said housing;

said resilient spring means includes a plurality of spring collet fingers extending upward from said plug means;

said downward facing surface of said releasable retaining means is defined on a plurality of shoulders, one of which shoulders extends radially outward from each of said spring collet fingers; and said back-up means includes a pressure balanced piston means initially located between and engaging radially inner surfaces of at least two of said spring collet fingers to hold said shoulders of said at least two spring collet fingers within said annular recess of said central bore of said housing.

5. The apparatus of claim 4, wherein:

said piston means is movable from said initial location downward relative to said spring collet fingers to a second position for allowing said spring collet fingers to be displaced radially inward due to a downward force exerted on said plug means thereby releasing said plug means from said housing.

6. The apparatus of claim 5, wherein:

said piston means is releasably retained in its initial location by shear pin means connecting said piston means to at least one of said spring collet fingers.

7. The apparatus of claim 5, wherein:

said piston means is an annular piston means having a central opening disposed longitudinally therethrough, and said piston means includes a filter means, covering said central opening, for preventing particulate material from passing through said opening and collecting on top of the plug means.

8. The apparatus of claim 1, wherein:

said isolation means includes securing means for securely attaching said housing to said isolation casing when said housing is received within said central cavity of said isolation casing.

9. The apparatus of claim 8, wherein:

said housing is initially attached to said operating tool string by a releasable housing retaining means for releasing said housing from said operating tool string after said housing is securely attached to said isolation casing.

10. The apparatus of claim 1, further comprising:

annular seal means disposed between said plug means and said central bore of said housing for sealing therebetween.

11. The apparatus of claim 1, wherein:

said housing has an open lower end so that said plug means may be completely removed from said housing by displacing said plug means downward relative thereto.

12. An apparatus for packing a zone of a well bore with a particulate material, comprising:

an upper packer means including a packer body having a longitudinal body passageway disposed therethrough and including an expandable packing element for sealing against said well bore at an upper end of said zone, said packer body including a lower body extension having port means associated therewith for communicating said zone with an interior of a supply tubing string means for supplying said particulate material to said zone;

intermediate tubing connected to a lower end of said packer body, said intermediate tubing having a longitudinal tubing passageway disposed therethrough, said tubing passageway being communicated with said longitudinal body passageway of said upper packer means;

production screen means, connected to a lower end of said intermediate tubing, for communicating said zone of said well bore with a lower end of said longitudinal tubing passageway of said intermediate tubing;

isolation means, disposed in said intermediate tubing, for blocking said longitudinal tubing passageway and thereby isolating said zone of said well bore from said well bore above said upper packer means after said zone is packed with said particulate material and said port means is closed, said isolation means being releasable for unblocking said longitudinal tubing passageway and thereby communicating said zone with a production tubing connected to said packer body for producing fluid from said zone, said isolation means including:

a housing having a central bore communicated with said longitudinal tubing passageway;

plug means disposed in said central bore for blocking said central bore and said longitudinal passageway; and releasable retaining means for retaining said plug means in said central bore and for subsequently releasing said plug means so that it may be displaced from said central bore to unblock said central bore and said longitudinal tubing passageway, said releasable retaining means of said isolation means including means for preventing release of said plug means due to fluid pressure variations within said longitudinal tubing passageway;

a seal bore nipple connected to a lower end of said production screen means;

a tell tail screen means connected to a lower end of said seal bore nipple; and a wash pipe, attached to a lower end of said supply tubing means;

wherein, said intermediate tubing includes an isolation casing having a central cavity for receiving said housing of said isolation means therein;

said packer body of said upper packer means further includes a second port means associated therewith for communicating an interior of said wash pipe with said well bore above said upper packer means; and said housing of said isolation means is initially attached to a lower end of said wash pipe and said housing further includes a cylindrical outer surface sealingly received in said seal bore nipple and includes a circulating port associated therewith for communicating said interior of said wash pipe with said zone of said well bore through said tell tail screen means.

13. The apparatus of claim 12, wherein:

said isolation means includes securing means for securely attaching said housing to said isolation casing when said housing is received within said central cavity of said isolation casing.

14. The apparatus of claim 13, wherein:

said housing is initially attached to said wash pipe by a releasable housing retaining means for releasing said housing from said wash pipe after said housing is securely attached to said isolation casing.

15. An apparatus for isolating an upper portion of a well bore from a lower portion of said well bore, comprising:

an annular packer means including a packer body having a longitudinal passageway disposed therethrough, and including an expandable packing element for sealing an annulus between said packer body and said well bore between said upper and lower portions of said well bore;

isolation means, connected to said packer body, for blocking said longitudinal passageway and thereby isolating said upper portion of said well bore from said lower portion of said well bore, said isolation means including:

a housing having a central bore communicated with said longitudinal passageway and including an upward facing support surface disposed in said central bore;

plug means disposed in said central bore for blocking said central bore and said longitudinal passageway; and releasable retaining means for retaining said plug means in said central bore and for subsequently releasing said plug means so that it may be displaced from said central bore to communicate said upper portion of said well bore with said lower portion of said well bore, said releasable retaining means including means for preventing release of said plug means due to fluid pressure variations within said longitudinal passageway of said packer body, a downward facing surface located above said support surface of said housing and engaged with said support surface to retain said plug means in said central bore of said housing, and resilient spring means including a plurality of spring collet fingers extending upwardly from said plug means for resiliently urging said downward facing surface and said support surface into engagement, said spring means being displaceable to disengage said downward facing surface and said support surface;

wherein said downward facing surface of said releasable retaining means is defined on a plurality of shoulders, one of which shoulders extends radially outward from each of said spring collet fingers; and wherein said means for preventing release of said plug means includes a back-up means for preventing said resilient spring means from being displaced due to fluid pressure variations within said longitudinal passageway of said packer body, said back-up means including pressure balanced piston means initially located between and engaging radially inner surfaces of at least two of said spring collet fingers to hold said shoulders of said at least two spring collet fingers within said annular recess of said central bore of said housing, said piston means being movable from said initial location downward relative to said spring collet fingers to a second position for allowing said spring collet fingers to be displaced radially inward due to a downward force exerted on said plug means thereby releasing said plug means from said housing; and wherein said piston means is an annular piston means having a central opening disposed longitudinally therethrough, and said piston means includes a filter means, covering said central opening, for preventing particulate material from passing through said opening and collecting on top of the plug means.

16. A method of gravel packing a zone of a well bore and of isolating an upper portion of said well bore from said zone located therebelow upon completion of said gravel packing operation on said zone, said method comprising the steps of:

setting an upper packer means in said well bore at an upper end of said zone;

gravel packing said zone by flowing a gravel slurry down a tubing string connected to a packer body of said upper packer means and through port means associated with said packer body into said zone;

blocking a longitudinal passageway of said packer body with a releasable isolation means prior to completely withdrawing said tubing string from said packer body;

closing said port means prior to completely withdrawing said tubing string from said packer body;

completely withdrawing said tubing string from said packer body, thereby communicating said longitudinal passageway of said packer body with said upper portion of said well bore; and thereby isolating said upper portion of said well bore from said gravel packed zone so long as said longitudinal passageway remains blocked by said releasable isolation means.

17. The method of claim 16, further comprising the steps of:

connecting a production tubing string to said upper packer means so that an interior of said production tubing string is in fluid communication with said isolation means;

then releasing said isolation means and unblocking said longitudinal passageway of said packer body; and thereby communicating said interior of said production tubing string with said gravel packed zone of said well bore so that fluids from a subsurface formation adjacent said gravel packed zone of said well bore may be produced through said production tubing string.

18. The method of claim 17, wherein:

said releasing step is further characterized as releasing said isolation means by physically engaging said isolation means with a releasing tool.

19. The method of claim 18, further comprising the step of:

prior to said releasing step, preventing release of said isolation means due to fluid pressure acting upon said isolation means.

20. The method of claim 17, wherein said releasable isolation means inlcudes a housing having a central bore, plug means disposed in said central bore, a plurality of spring collet fingers extending upward from said plug means and having shoulders extending radially outward therefrom and resiliently engaging an inner annular groove disposed in said central bore, and a pressure balanced piston initially located between and engaging radially inner surfaces of at least two of said spring collet fingers to hold said shoulders of said at least two spring collet fingers within said annular groove of said central bore of said housing, wherein said releasing step includes steps of:

pushing downward on said piston with a releasing tool; thereby moving said piston downward relative to said spring collet fingers to a position such that said spring collet fingers may be displaced radially inward;

then camming said shoulders of said spring collet fingers radially inward out of engagement with said annular groove of said central bore;

then pushing said plug means down and out of said central bore of said housing; thereby unblocking said longitudinal passageway of said packer body.

21. The method of claim 16, wherein:

said blocking step is performed prior to said step of setting said upper packer means in said well bore.

22. The method of claim 16, wherein:

said blocking step is performed after said step of setting said upper packer means in said well bore.

23. The method of claim 22, said method being further characterized as a method of gravel packing said zone by a circulating pack method, said method further comprising the steps of:

initially attaching said releasable isolation means to a lower end of a wash pipe; and initially locating said isolation means so that an outer cylindrical surface of a housing of said isolation means sealingly engages a bore of a seal bore nipple connected to a lower end of said packer body, and so that a circulating port associated with said housing communicates with said zone through a tell tail screen connected to a lower end of said seal bore nipple;

wherein said step of gravel packing includes steps of:

circulating fluid from said slurry in said zone through said tell tail screen, then through said circulating port of said housing of said isolation means, then up through said wash pipe, then through an upper circulating port means associated with said packer body into an annulus of said well bore surrounding said tubing string above said upper packer means, until a lower portion of said zone is gravel packed up to said tell tail screen;

then closing said upper circulating port means thereby preventing further circulation; and then gravel packing a remainder of said zone; and wherein said blocking step includes the steps of:

after said gravel packing of said zone is completed, lifting said wash pipe and said attached isolation means relative to said upper packer means;

engaging said isolation means with an isolation casing connected to a lower end of said packer body; and securely attaching said isolation means to said isolation casing thereby blocking said longitudinal passageway of said packer body.

* * * * *